US010262622B2

(12) United States Patent
Bi et al.

(10) Patent No.: US 10,262,622 B2
(45) Date of Patent: Apr. 16, 2019

(54) LOW POWER DISPLAY ON MODE FOR A DISPLAY DEVICE

(71) Applicant: Apple Inc., Cupertino, CA (US)

(72) Inventors: Yafei Bi, Palo Alto, CA (US); Lei He, Fremont, CA (US); Mohammad B. Vahid Far, San Jose, CA (US); Mir B. Ghaderi, Cupertino, CA (US); Venu Madhav Duggineni, Santa Clara, CA (US); Vanessa C. Heppolette, Palo Alto, CA (US); Joshua P. De Cesare, Campbell, CA (US); Hyuck-Jae Lee, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 79 days.

(21) Appl. No.: 15/260,580

(22) Filed: Sep. 9, 2016

(65) Prior Publication Data

US 2017/0169763 A1 Jun. 15, 2017

Related U.S. Application Data

(60) Provisional application No. 62/267,786, filed on Dec. 15, 2015.

(51) Int. Cl.
*G09G 5/00* (2006.01)

(52) U.S. Cl.
CPC ..... *G09G 5/003* (2013.01); *G09G 2310/08* (2013.01); *G09G 2320/06* (2013.01); *G09G 2330/021* (2013.01)

(58) Field of Classification Search
CPC combination set(s) only.
See application file for complete search history.

(56) References Cited

U.S. PATENT DOCUMENTS

| | | | | |
|---|---|---|---|---|
| 9,041,626 | B2 * | 5/2015 | Park | G09G 3/20 345/211 |
| 9,189,048 | B2 | 11/2015 | Wilson et al. | |
| 2009/0212949 | A1 * | 8/2009 | Tsai | G08B 13/1436 340/571 |
| 2010/0328199 | A1 | 12/2010 | Piasecki et al. | |
| 2011/0037790 | A1 | 2/2011 | Onishi | |
| 2013/0257925 | A1 * | 10/2013 | Kim | G09G 3/003 345/691 |
| 2014/0111315 | A1 * | 4/2014 | Geerlings | G07C 9/00309 340/12.5 |
| 2014/0281634 | A1 | 9/2014 | Rotem et al. | |
| 2015/0070364 | A1 | 3/2015 | Anantharaman et al. | |

* cited by examiner

*Primary Examiner* — Van N Chow
(74) *Attorney, Agent, or Firm* — Kilpatrick Townsend & Stockton

(57) ABSTRACT

This application relates to systems, methods, and apparatus for transitioning a display device between operating modes using a single dedicated pin of a circuit connected to the display device. The dedicated pin can receive a packet signal corresponding to an operating mode for the display device, and the circuit can thereafter cause the display device to transition into the desired operating mode in response to receiving the packet signal. The operating mode can be a low power on mode where an interface connected to the circuit is deactivated and at least some circuitry of the display device is throttled or powered off. The display device can be driven in an all black state while in the low power on mode, thereby allowing the display device to more quickly transition out of the low power on mode compared to when the display device is completely off.

20 Claims, 7 Drawing Sheets

LOW POWER DISPLAY ON MODE FOR A DISPLAY DEVICE

CROSS-REFERENCE TO RELATED APPLICATION

The present application claims the benefit of U.S. Provisional Application No. 62/267,786, entitled "LOW POWER DISPLAY ON MODE FOR A DISPLAY DEVICE," filed Dec. 15, 2015, the content of which is incorporated herein by reference in its entirety for all purposes.

FIELD

The described embodiments relate generally to display devices. More particularly, the present embodiments relate to a low power display mode that can be enabled and disabled using at least one single pin of a display device.

BACKGROUND

Various computing devices incorporate display devices that provide a variety of functionality for each computing device. While such display devices can boost the utility of certain computing devices, many display devices can inefficiently consume power. As a result, for certain mobile devices that incorporate batteries, inefficient power use can result in battery power being depleted in a short amount of time. Although a user can choose to completely shut off their device to preserve battery power, the time it takes for a device to startup from an off state and be able to display images can be substantially prolonged as a result of the system architecture of some devices.

SUMMARY

This paper describes various embodiments that relate to display devices that can transition between operating modes based on a packet signal received at a single dedicated pin of a circuit of a display device. In some embodiments, a method is set forth for operating a display device in a low power mode. The method can include a step of deactivating an interface connected to a circuit of the display device. The method can further include a step of operating the display device according to a predefined operating state using a display controller of the display device. Additionally, the method can include a step of providing a packet signal to a dedicated pin of the circuit, and the packet signal can include a signature that identifies the low power mode. The packet signal can be exclusively received at the dedicated pin for transitioning the display device into the predefined operating state. The predefined operating state can correspond to an all black image frame. The display controller can remain active when the interface of the circuit is deactivated. The interface can be connected to both a host device and the circuit, and the host device can deactivate a backlight of the display device when the display device is operating in the predefined operating state.

In some embodiments, a method is set forth for controlling a display mode of a display device. The method can include a step of receiving, at a dedicated pin of a circuit connected to the display device, a packet signal that identifies a display mode of multiple display modes in which the display device can operate. The method can also include a step of transitioning the display device into the display mode in response receiving the packet signal. Transitioning the display device into the display mode can include deactivating or activating an interface that is connected to the circuit. The method can also include operating the display device according to a host device or a display controller that remains in communication with the display device when the interface of the circuit is deactivated. The packet signal can be exclusively received at the dedicated pin for transitioning the display device into the display mode. The display mode can be a low power display mode characterized in that a pixel array of the display device is driven into a grounded state. Furthermore, when operating in the low power display mode, at least a portion of the pixel array of the display device can be driven by a display controller or display driver of the display device, and an interface connected to the host device and the circuit can be deactivated.

In other embodiments, a display device is set forth. The display device can include an interface and a circuit comprising a dedicated pin. The interface can be configured to activate or deactivate in response to a packet signal being received at the dedicated pin. The display device can also include a host device connected to the circuit and configured to generate the packet signal for the dedicated pin. The display device can further include a display panel connected to the host device and configured to operate according to the host device when the interface of the circuit is deactivated. The display panel can include a display driver that can be configured to at least partially activate or deactivate according to the packet signal received at the dedicated pin. The host device or other control circuit of the display device can be configured to generate at least three different packet signals for the dedicated pin of the circuit and each of the at least three different packet signals can be associated with at least one of three different operating modes of the display panel. The host device can also be configured to generate different packet signals for the dedicated pin, and the circuit can further include a filter configured to output different control signals based on which of the different packet signals is received at the dedicated pin. The host device can be connected to the circuit via the dedicated pin and the interface. Additionally, the host device can be further configured to control a backlight of the display panel when the interface of the circuit is deactivated. The display panel can include a gamma controller or a display driver that is deactivated when the display device is outputting a black display frame and the interface of the circuit is deactivated.

In yet other embodiments, a computing device is set forth. The computing device can include a housing comprising an opening, and a display device disposed within the opening. The display device can include a display panel, an interface, a circuit connected to the interface and comprising a dedicated pin, and a host device connected to the display panel and the dedicated pin. The host device or other control circuit of the display device can be configured to provide different packet signals to the dedicated pin to cause the interface to activate or deactivate, and transition the display panel between operating modes. The operating modes of the display panel can include a low power display on mode characterized in that the interface of the circuit is deactivated and the display panel operates according to a minimal amount of charge for the display panel to provide a black output. The different packet signals include a high signal, a low signal, and a pulse signal. The display panel can include a gamma controller and a display driver that are each configured to deactivate at least when the interface of the circuit is deactivated. The display panel can include a pixel array that can be configured to receive a signal from the host device at least when the interface of the circuit is deactivated. The host device can be further configured to deactivate a backlight of the display panel when the interface of the circuit is deactivated.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1:
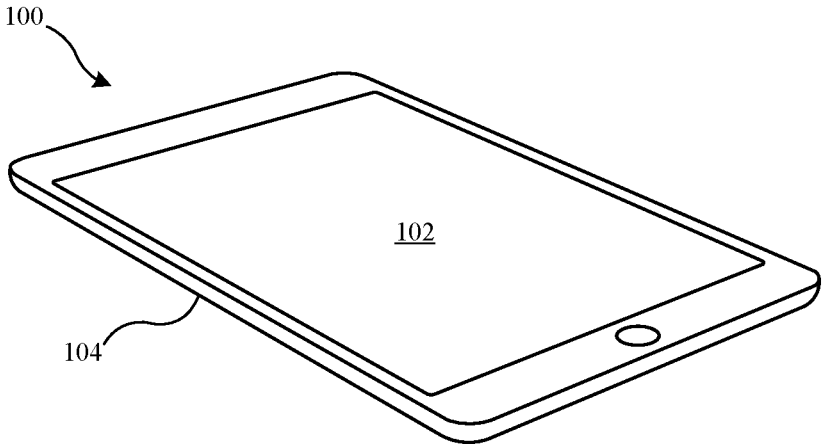
FIG. 1 illustrates a perspective view of a computing device that can include a display device operable in various operating modes.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Many computing devices incorporate a display device that provides a colorful interface with which a user can interact with their respective computing device. However, many display devices can inefficiently consume power, even when the user is not directly interacting with their computing device. In order to provide for a more efficient display device that consumes less power over a period of use for the computing device, the display device can operate according to a variety of operating modes. However, transitioning between operating modes can result in some latency because of the architecture of some display devices. In order to overcome these and other shortcomings of certain display devices, a single pin can be used as a basis for transitioning a display device between operating modes, as further discussed herein. Additionally, the display device can operate in certain operating modes without certain circuits and devices of the display device being fully activated, as discussed herein. In this way, the display device can operate at a reduced power with only certain circuits being activated (e.g., a display controller or a display driver can at least be partially activated in certain low power modes to enable some functionality of the display device while also preserving power).

In some embodiments provided herein, a display device is set forth as having at least a display device, a host device, a circuit, and an interface connected between the host device and the circuit. The circuit can include a multi-purpose dedicated pin for receiving several different kinds of packet signals that each correspond to different operating modes for the display device. The packet signals can include a high voltage signal corresponding to a logical high or on state, a low voltage signal corresponding to a logical low or off state, or a combination of logical high and logical low signals. In some embodiments, the packet signals can each include a predefined and/or unique signature that corresponds to an instruction to transition from or stay in a current operating mode. The packet signals can additionally include a pulsed voltage or pulsed current signal, characterized by synchronous or asynchronous pulses. Each of the packet signals can be received at the dedicated pin of the circuit of the display device and decoded by the circuit.

The different operating modes of the display device can include a full on mode, a full off mode, a low power on mode, and/or one or more sleep modes. Each of these modes can be transitioned in and out of based on the packet signal received at the dedicated pin of the circuit of the display device. For example, the low power on mode can be transitioned into when the high voltage packet signal is received at the dedicated pin. The low power on mode can transition into the full on mode of when the low voltage packet signal is received at the dedicated pin. Alternatively, the low power on mode can transition into a sleep mode when the pulsed packet signal is received at the dedicated pin. In this way, less pins of the display device are needed for controlling operating modes of the display device. It should be noted that any of the packet signals can be used to transition in and out of any of the operating modes discussed herein.

The low power on mode can be characterized as a display mode where some of the display device circuitry is powered off while some of amount of charge is being received or is retained by the display device. For example, the display device can include a source driver, a backlight, a gamma controller, and a pixel array that can include pixels, capacitors, and transistors. During the low power on mode, one or more of the source driver, the backlight, and/or the gamma controller can be powered off or operated at a reduced power state in response to one of the packet signals being received at the circuit of the display device. Furthermore, during the low power one mode, the pixel array can be in a state corresponding to a predetermined image frame, such as an all black image frame. In some embodiments, some or all of the transistors of the pixel array can be in a ground state during the low power on mode. In other embodiments, some or all of the capacitors of the pixel array can be arranged to retain some amount of charge when the display device is in the low power on mode. In yet other embodiments, a voltage is applied to some or all of the pixels of the pixel array when the display device is in the low power mode. In this way, some amount of the display device will be conditioned for transitioning into a full display on mode, thereby reducing latency that can occur when transitioning between operating modes. Additionally, this can reduce display artifacts that can occur when a pixel array of a computing device is left without any definite operating state while the computing device is performing processes that do not necessitate activating the display device.

The circuit that includes the dedicated pin for receiving the packet signals can be an application specific integrated circuit (ASIC) for at least partially controlling a display device. The display device can be a liquid crystal display (LCD), or any other display device that can operate in a low power mode such as an organic light emitting diode (OLED) display or light emitting diode (LED) display. The circuit can be connected to a host device, such as a system on a chip (SoC), through an interface. The interface can be any suitable circuit or device for converting signals from the host device into signals for the circuit. The circuit can also be connected to the host device through the dedicated pin of the circuit. The host device, or a display driver or a display controller of the display device, can provide the packet signals discussed herein for transitioning the display device between operating modes. The circuit can be arranged to control different circuits of the display device, such as the source driver. Therefore, when the circuit determines a particular packet signal has been received at the dedicated pin, the circuit can turn off or throttle the source driver. Additionally, the interface an also be turned off or turned on in response to one or more of the packet signals being received at the dedicated pin of the circuit from the host device. When the interface is turned off, the host device, or other display controller or display driver, can remain as the controller for driving the display device during the low power on mode. The host device, or other display controller or display driver, can therefore drive the pixel array in a state corresponding to an all black display frame. The all black display may consume some amount of power relative to an all off mode for the display device. In some embodiments, touch input and/or force touch can be received at the display device when the display device is operating in the low power on mode. Touch inputs and force touch inputs at the display device can be used to remotely control other devices external to the computing device that is incorporating the display device. For example, when the computing device is connected to another device over a cellular network, a Wi-Fi network, or a Bluetooth connection, the display can operate in the low power on mode and simultaneously provide, to the other device, signals that are based on touch inputs received at the display device of the computing device.

In order to distinguish the packet signals being received at the dedicated pin of the circuit, the circuit can include a filter and a clock. By using the filter and the clock, the circuit is able to distinguish between glitches and actual packet signals. For example, each packet signal can be associated with a threshold time that can be measured by the circuit using the clock. If a particular packet signal is not received for a corresponding threshold duration, the display device will not transition operating modes as a result. Furthermore, the filter can operate as a counter that counts pulses when a packet signal is provided with a pulse. In this way, if a packet signal is not received with at least a corresponding threshold amount of pulses, the filter will not output an appropriate control signal for transitioning the display device between operating modes. Thresholds for certain packet signals can correspond to pulse heights, pulse durations, time between pulses, total pulses, and/or any other suitable metric for characterizing signals. For example, a frequency signature of certain packet signals can be calculated by the circuit using Fourier transform analysis, and certain frequency signatures can correspond to certain operating modes for the display device.

These and other embodiments are discussed below with reference to FIGS. 1-7; however, those skilled in the art will readily appreciate that the detailed description given herein with respect to these figures is for explanatory purposes only and should not be construed as limiting.

FIG. 1 illustrates a perspective view of a computing device 100 that can include a housing 104 that supports a display 102 positioned in an opening of the housing. The computing device 100 can be any device including, but not limited to, a phone, a media player, a laptop computer, a desktop computer, a tablet computer, an accessory device such as a watch, a display device, and/or any other device that can incorporate a display panel. The display 102 can be a liquid crystal display (LCD) that includes a backlight and display circuitry for driving the display 102. However, in some embodiments, the display 102 can be any other type of display such as a light emitting diode (LED) display or an organic light emitting diode (OLED) display. Additionally, the display 102 can include touch sensitive features for providing touch input to software on the computing device 100 by way of touching the display 102 or providing some gesture to the display 102. The display 102 can operate in a variety of operating modes such as an on mode, off mode, sleep mode, and low power on mode. Transitioning between the operating modes can be performed by sending one or more packet signals to a single pin or node of a circuit of the display 102, as further discussed herein. In this way, less circuit pins are needed to transition the display 102 between operating modes, thereby allowing other functions to be implemented by the display 102.

When operating in the low power on mode, different circuits of the display 102 can be throttled or completely turned off. For example, the display 102 can include a display panel, a source driver, a timing controller, a scan driver, a gamma controller, a gate driver, a backlight, and/or any other circuit or device suitable for driving a display device. When operating in the low power on mode, one or more of the circuits (e.g., the scan driver) can be throttled or turned off while simultaneously leaving some amount of voltage or current charging the display 102. For example, the scan driver or the timing controller can provide at least some amount of charge to the display 102 in the low power on mode. In this way, the low power display on mode reduces the amount of power consumed by the display 102 while also allowing the display 102 to transition more quickly between the low power display on mode and the on mode. Throttling and/or turning off the circuits of the display 102 can be performed in part by a primary circuit or application specific integrated circuit (ASIC) as discussed herein. During the low power display on mode, the display 102 can be driven according to a predetermined image frame pattern, such as an all black image frame. When outputting the predetermined image frame pattern, a pixel array of the display panel can be put into a ground state. Alternatively, when outputting the predetermined image frame pattern, capacitors of the pixels array can receive or retain some amount of charge while the backlight is turned off, thereby reducing latency when transitioning to the on mode where the capacitors may potentially need to be charged.

Figure 2A:
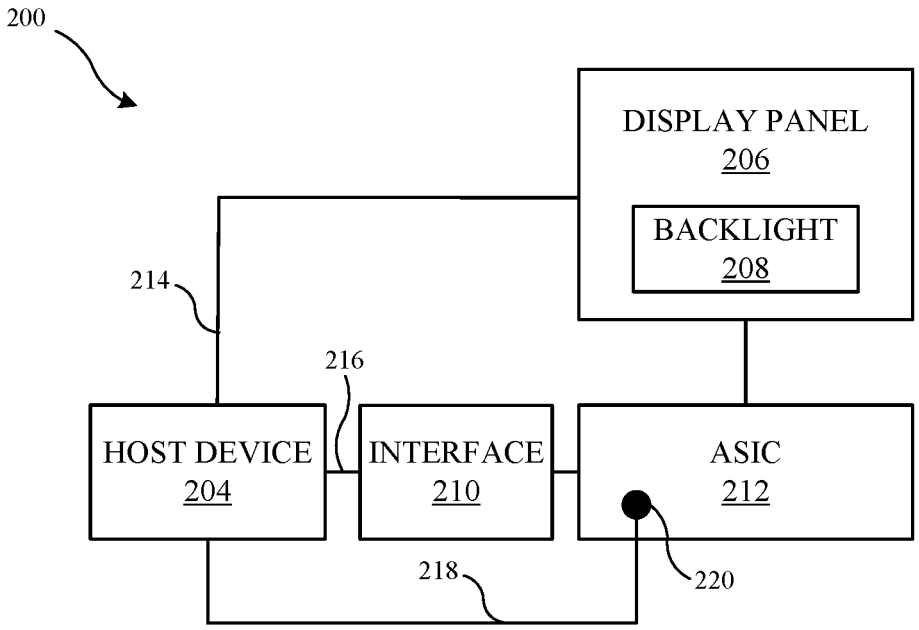
FIGS. 2A and 2B show system diagrams that illustrate how the display device can transition between different operating modes.
Figure 2B:
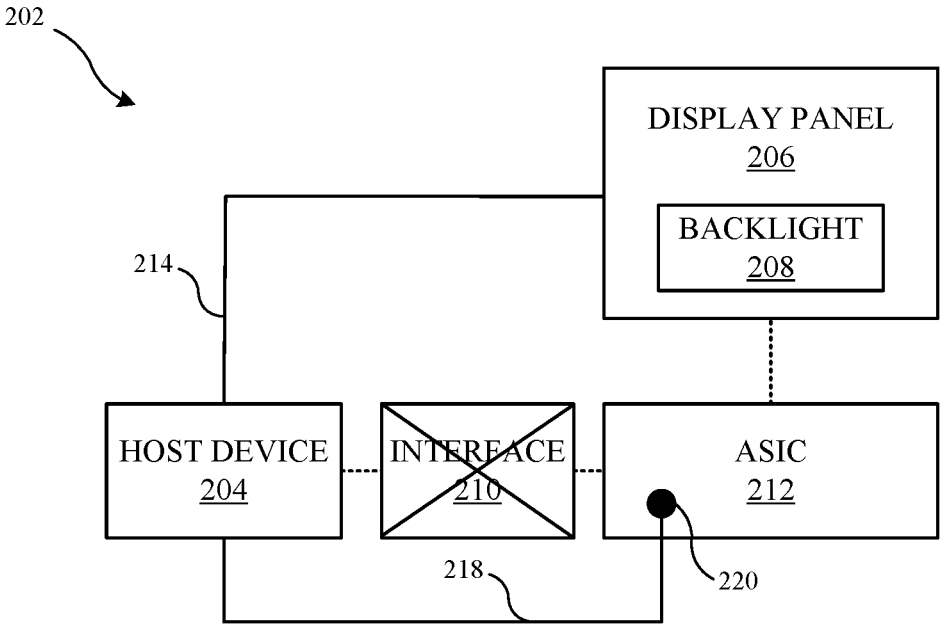

FIGS. 2A and 2B illustrate system diagrams 200 and 202 having a display panel 206 that can transition between operating modes in response to a packet signal 218 being received at a dedicated pin 220. The dedicated pin 220 can be located on a circuit such as an application specific integrated circuit (ASIC) 212. The ASIC 212 can control the display panel 206 and one or more of the circuits of the display panel 206, such as a source driver, gamma controller, gate driver, and/or any other suitable circuit that can be in communication with a display panel 206. A host device 204 can communicate with the ASIC 212 through an interface 210. The host device 204 can be any processor and/or system on a chip (SoC) suitable for controlling operations of a display device. The interface 210 can convert a control signal 216 from the host device 204 into a format that can be readable to the ASIC 212. Additionally, the host device 204 can generate one or more packet signals 218 for the dedicated pin 220 of the ASIC 212. The packet signal 218 can correspond to a high signal, such as a digital high or on signal, a low signal, such as a digital off or low signal, and/or a pulsed signal, such as a synchronous or asynchronous pulse. The packet signal 218 can initiate a transition of the display panel 206 into the low power on mode, or any of the operating modes discussed herein. For example, the host device 204 can transmit the packet signal 218 to the dedicated pin 220 of the ASIC for transitioning the display panel 206 into the low power on mode. In response, the interface 210 can be temporarily deactivated until the display panel 206 is transitioned into an operating mode that uses the interface 210.

The deactivation of the interface 210 is provided in the system diagram 202 of FIG. 2B, which illustrates the interface 210 as crossed out and the connections to the interface 210 being temporarily disabled or open circuits (as indicated by dotted lines). Additionally, in response to the ASIC 212 receiving the packet signal 218 corresponding to the low power on mode, the control of the ASIC 212 over the display panel 206 can be limited. For example, the ASIC 212 can disable or throttle different circuits of the display panel 206 in response to receiving the packet signal 218 at the dedicated pin 220. The host device 204 can also disable a backlight 208 of the display panel 206 using a display signal 214 when the display panel 206 is operating in the low power on mode. When the display panel 206 is operating in the low power on mode certain display control circuits, such as a timing controller or a display driver, connected to the display panel 206 can be used to drive the display panel 206 according to a predetermined image frame, such as an all black image frame. For example, the display control circuits can cause a pixel array of the display panel 206 to be transitioned into a ground state so that nodes of the pixel array are not left without any definite state. Alternatively, the display control circuits can cause capacitors of the pixel array to receive or retain a charge during the low power on mode in order that the display panel 206 can transition out of the low power on mode more quickly than if the capacitors were completely discharged. Furthermore, when operating in the low power on mode, pixels and/or transistors of the pixel array of the display panel 206 can be driven into a state corresponding to an all black image frame. In this way, the pixels and/or the transistors are not left without any definite state when the display panel 206 is operating in the low power on mode.

Figure 3:
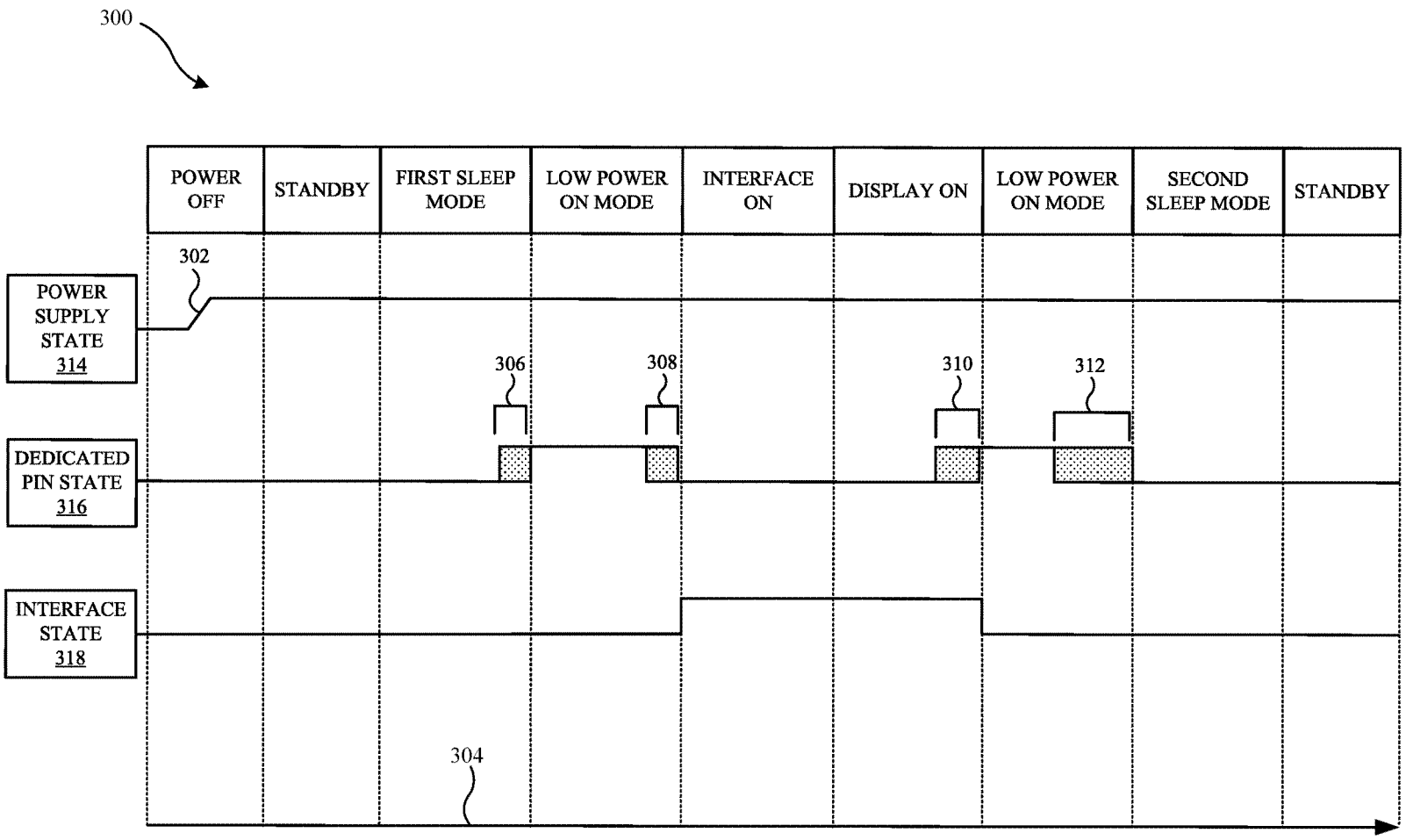
FIG. 3 shows a plot of how a packet signal being received at a dedicated pin can transition a display device between operating modes.

FIG. 3 illustrates a plot 300 of how a display panel, such as display panel 206 and/or display 102 can transition between various operating modes. The plot 300 can correspond to states of the display panel and/or a computing device that incorporates the display panel. The plot 300 includes a signal corresponding to a power supply state 314, which can indicate whether a power supply of the computing device and/or the display panel 206 is on or off. The plot 300 can also include a dedicated pin state 316, which can indicate an operating state of a dedicated pin of a circuit connected to the display panel, as discussed herein. The plot 300 can further include an interface state 318 corresponding to a state of an interface connected to the circuit of the display panel, as discussed herein. Initially, the computing device can transition from a power off state to a standby state in response to the power supply state 314 transitioning from low to high at step 302. The computing device can thereafter transition into a first sleep mode after the computing device has been in the standby state for a predetermined period of time 304. The computing device and/or display panel can transition into a low power on mode when the dedicated pin state 316 transitions from a low to a high state for a predetermined amount of time 306. However, it should be noted that the display panel can transition into the low power on mode in response to the dedicated pin state 316 changing according to any of the packet signals discussed herein (e.g., high, low, pulse, as provided by the filled blocks of FIG. 3). In order to transition out of the low power on mode, the dedicated pin state 316 can go from high to low for a predetermined amount of time 308. The low power on mode can be characterized by at least the interface between a host device and a circuit of the display panel being deactivated. Therefore, when the display panel transitions out of the low power on mode, the interface state 318 transitions from a low to a high state, indicating that the interface is activated. Once the interface is on, the display panel can transition to a display on mode. The display panel can transition into the low power mode from the display on mode when a packet signal is received at the dedicated pin for a predetermined amount of time 310, thereby changing the dedicated pin state 316. In order to enter a standby mode from the low power on mode, the dedicated pin can receive a packet signal 312 for transitioning out of the low power on mode. As a result, the computing device can enter a second sleep mode for a predetermined amount of time and thereafter enter the standby mode once certain features of the computing device have been throttled or powered off in the second sleep mode.

Figure 4:
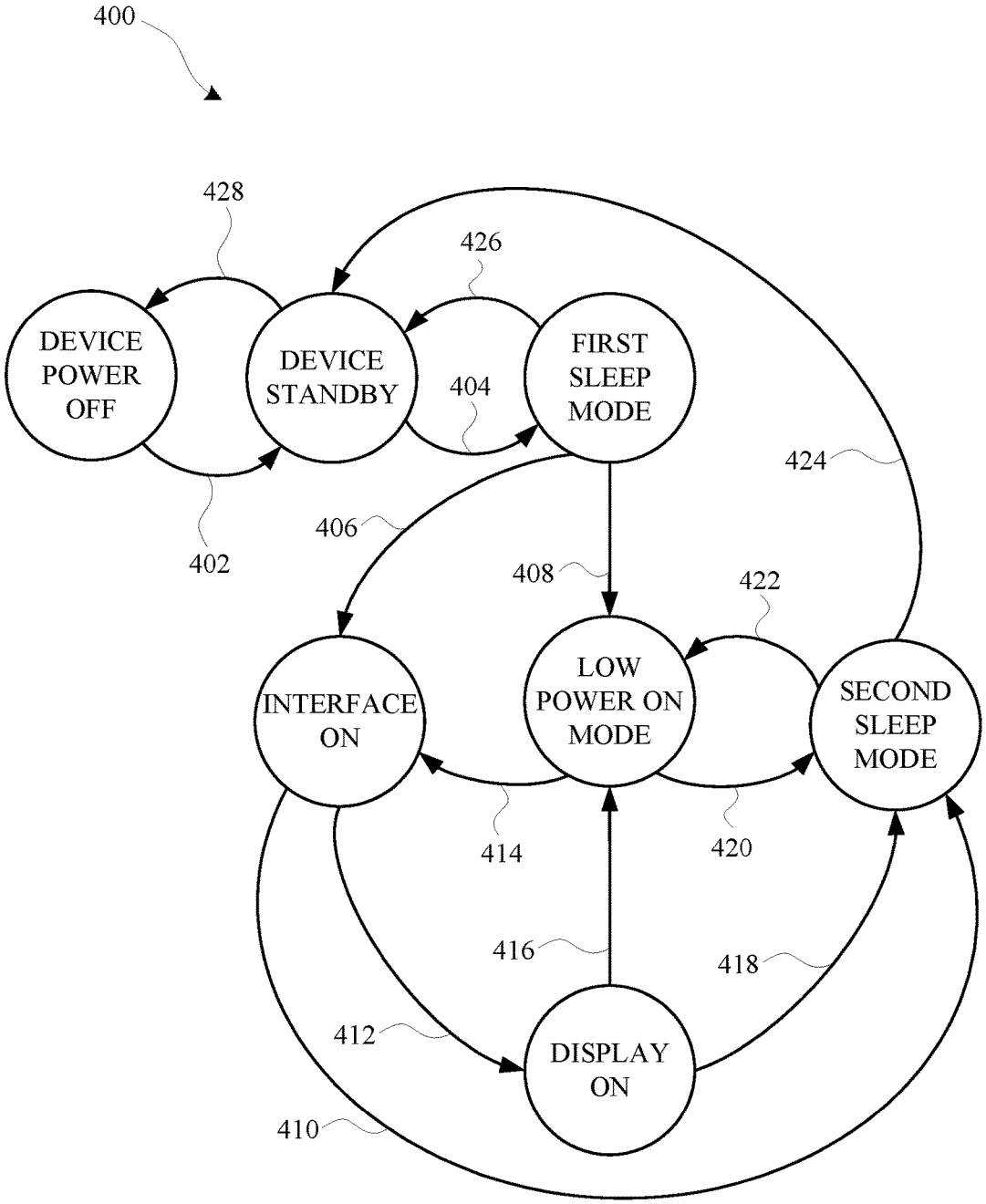
FIG. 4 illustrates a state diagram that details how a device and a display device of the device can transition between operating modes.

FIG. 4 illustrates a state diagram 400 for transitioning a display panel of a device between various operating modes. Initially, at step 402, the device can transition from a device power off state to a device standby state where at least a power supply of the device is turned on. At step 404, the device can transition into a first sleep mode where data from a memory of the device can be downloaded into a processor of the device. At step 406, the device can transition from the first sleep mode into an interface on mode where an interface connected to a circuit of the display panel can be turned on before images are displayed at the display panel. Alternatively, at step 408, the device can transition into a low power on mode where the interface is off and one or more circuits of the display panel are deactivated, as further discussed herein. However, the device can transition out of the low power on mode, at step 414, into the interface on mode in response to a dedicated pin of a circuit of the display panel receiving a packet signal, as discussed herein. From the interface on mode, at step 412, the device can transition into a display on mode where images can be displayed at the display panel. Alternatively, at step 410, the device can transition into a second sleep mode where the display panel is powered off in order that display artifacts are not displayed when re-entering the device standby mode at step 424. Once in the display on mode, the low power on mode can be entered, at step 416, in response to the dedicated pin receiving a particular packet signal, as discussed herein. Alternatively, at step 418, the device can enter the second sleep mode from the display on mode. The device can re-enter the low power on mode at step 422 and in response to the dedicated pin receiving a particular packet signal. Additionally, the device can enter the second sleep mode at step 420 in response to the dedicated pin receiving a particular packet signal, as discussed herein. From the second sleep mode, the device can re-enter the standby mode at step 424, and thereafter enter the device power off mode at step 428, wherein the power supply of the device is powered off. It should be noted that any of the transitions and steps described with respect to FIG. 4 and throughout this document can be initiated and/or controlled by the host device discussed herein, or any other processor directly or indirectly connected to the display panel.

Figure 5:
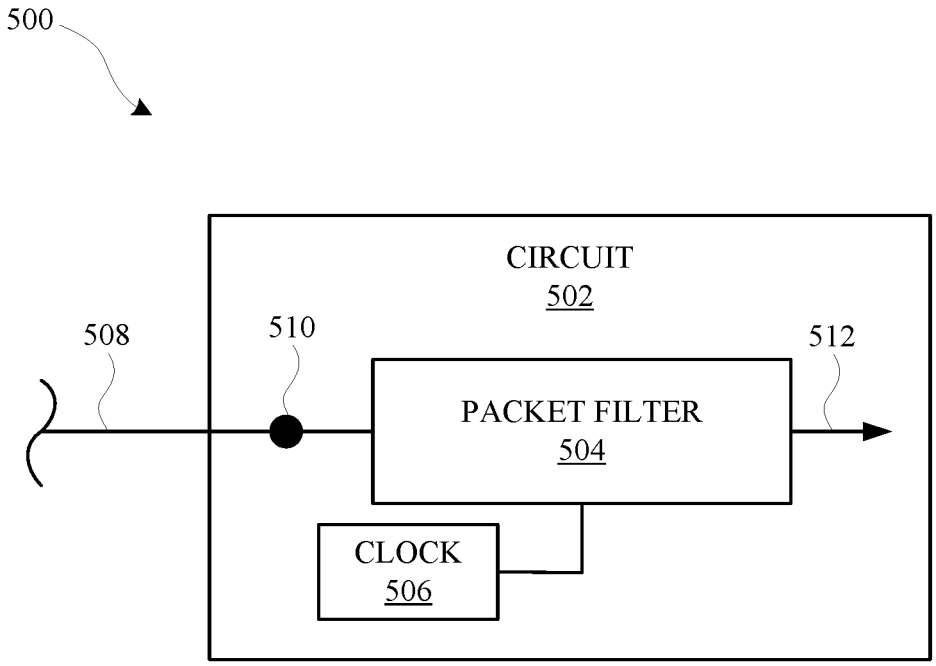
FIG. 5 illustrates a circuit that can distinguish between different packet signals using a packet filter and a clock input.

FIG. 5 illustrates a system 500 for providing a control signal 512 based on a packet signal 508 being received at a dedicated pin 510 of a circuit 502. The packet signal 508 can correspond to one or more packet signals that can transition a display panel between operating modes, as discussed herein. The circuit 502 can include a packet filter 504 for identifying a particular packet signal 508 and ensuring that any glitches in the signal received at the dedicated pin 510 do not cause accidental transitions for the display panel. The packet filter 504 can include an analog filter and/or a de-glitch filter for assisting the packet filter 504 in identifying the particular packet signal 508. The packet filter 504 can be connected to a clock 506 that provides a reference for the packet filter 504 for counting samples of the packet signal 508. For example, the packet filter 504 can count how long the packet signal 508 has been in a high or low state and output the control signal 512 when the packet signal 508 has been high or low for a predetermined amount of time. Additionally, when the packet signal 508 includes pulses, the packet filter 504 can measure a height, width, separation, and/or any suitable property of the pulses in order to characterize the packet signal 508. Once the pulses of the packet signal 508 have been characterized, the control signal 512 can be output according to the characterization of the pulses. In this way, pulsed packet signals can be used to transition a display panel between the various operating modes described herein.

Figure 6:
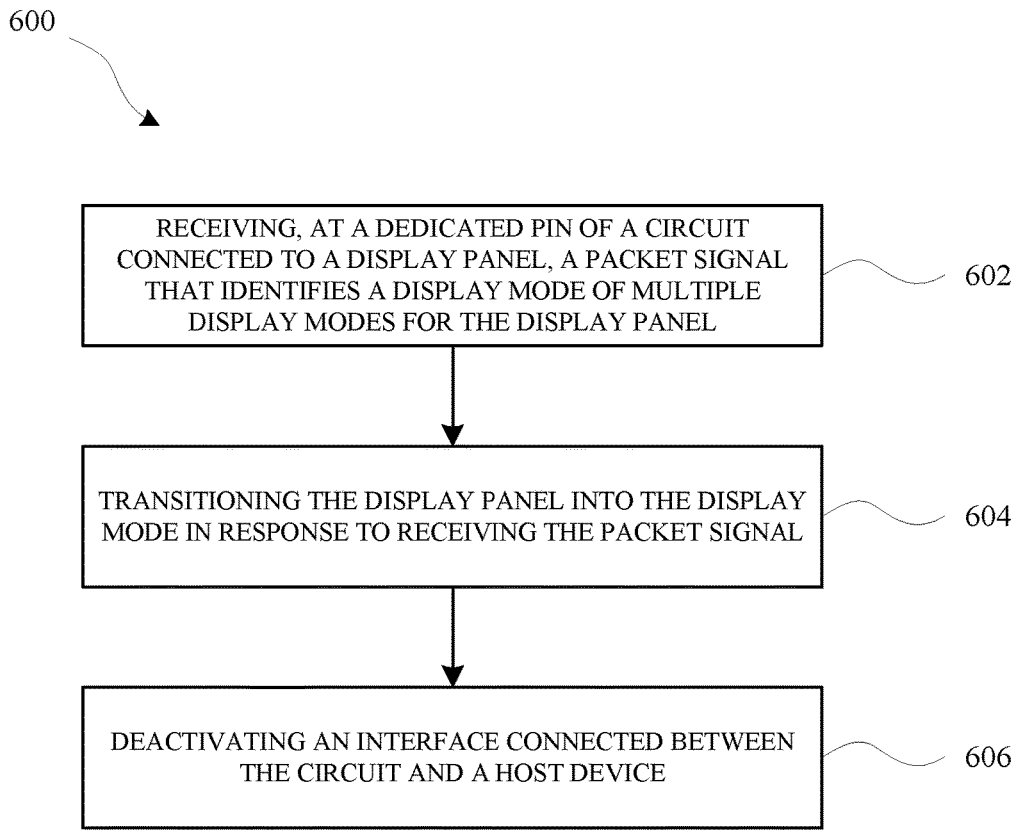
FIG. 6 illustrates a method for transitioning a display device into an operating mode based on a packet signal received at a dedicated pin of a circuit.

FIG. 6 illustrates a method 600 for transitioning a display panel between operating modes based on a packet signal received at a dedicated pin of a circuit, as further described herein. The method 600 can be performed by the circuit that includes the dedicated pin, as discussed herein, and/or any other suitable device that can control an operating mode of a display panel. The method 600 can include a step 602 of receiving, at the dedicated pin of the circuit connected to the display panel, a packet signal that identifies a display mode of multiple display modes in which the display panel can operate. The method 600 can also include a step 604 of transitioning the display panel into the display mode in response to receiving the packet signal. The method 600 can further include a step 606 of deactivating an interface connected between the circuit and a device, thereby reducing the risk of artifacts being displayed at the display panel when operating in the display mode.

Figure 7:
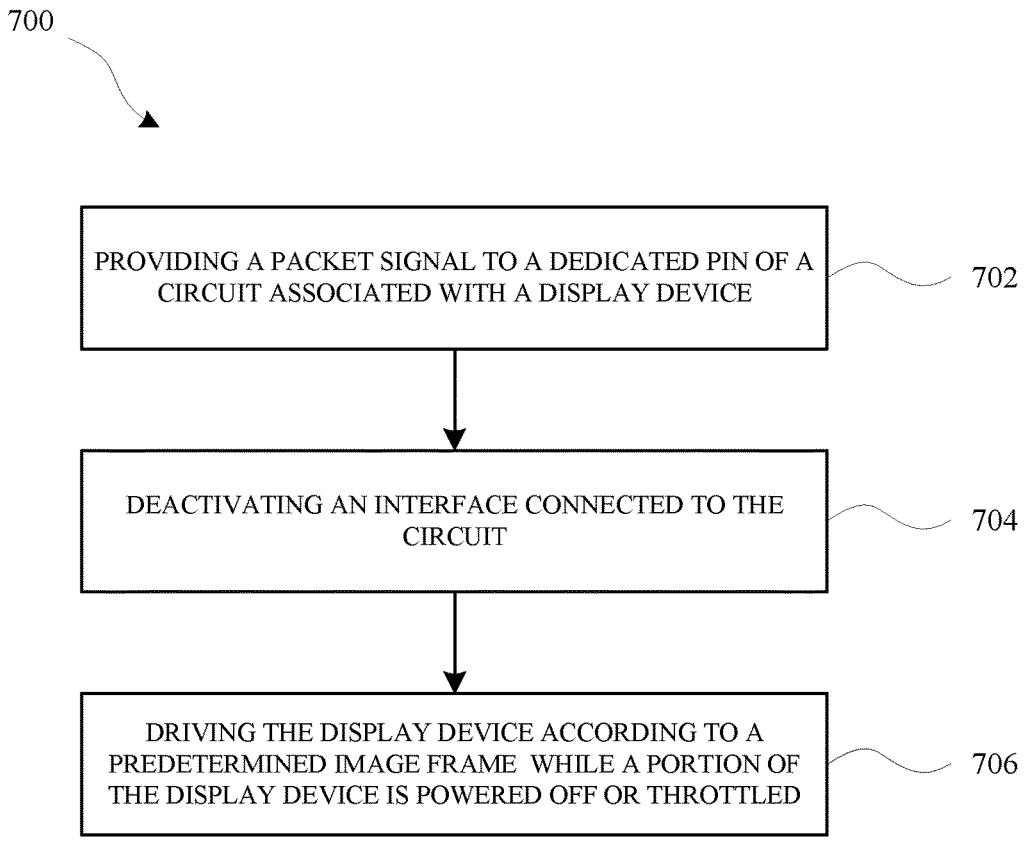
FIG. 7 illustrates a method for transitioning a display device into an operating mode based on a packet signal generated by a host device.

FIG. 7 illustrates a method 700 for transitioning a display panel into an operating mode corresponding to a particular packet signal. The method 700 can be performed by the host device, a display controller, a display driver, and/or any other suitable device that can control an operating mode of a display panel. The method 700 can include a step 702 of providing a packet signal to a dedicated pin of a circuit associated with the display panel. The method 700 can also include a step 704 of deactivating an interface connected to the circuit. The method 700 can further include a step 706 of driving the display panel according to a predetermined image frame while a portion of the display panel is powered off or throttled. For example, the display panel can be driven according to an all black frame that causes a pixel array of the display panel to be in a ground state, or a state where some amount of charge is retained by the pixel array. In this way, latency can be reduced when transitioning the display panel out of the display mode.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method for operating a display device in a low power mode, the method comprising:

deactivating an interface connected connecting a host device to a circuit of the display device; and operating the display device according to a predefined operating state based on an activation state of the interface using a display controller of the display device.

2. The method of claim 1, further comprising:

providing a packet signal to a dedicated pin of the circuit, wherein the packet signal includes a signature that identifies the low power mode.

3. The method of claim 2, wherein the packet signal is exclusively received at the dedicated pin for transitioning the display device into the predefined operating state.

4. The method of claim 1, wherein the predefined operating state corresponds to an all black image frame.

5. The method of claim 1, wherein the display controller remains active when the interface of the circuit is deactivated.

6. The method of claim 1, wherein the interface is connected to both a host device and the circuit, and the host device deactivates a backlight of the display device when the display device is operating in the predefined operating state.

7. A display device comprising:

a circuit comprising a dedicated pin, the circuit configured to receive at the dedicated pin a plurality of packet signals and to distinguish between different packet of the plurality of packet signals based on timings of the plurality of packet signals received at the dedicated pin; and a display panel connected to the circuit and configured to change operating modes in response to a packet signal of the different packet signals being received at the dedicated pin.

8. The display device of claim 7, wherein the display panel comprises a display driver that is configured to activate or deactivate based on the packet signal received at the dedicated pin.

9. The display device of claim 8, wherein the circuit is configured to distinguish between at least three different packet signals and each packet signal of the at least three different packet signals is associated with at least one of three different operating modes for the display panel.

10. The display device of claim 7, wherein the circuit further comprises a filter configured to output different control signals for the display device panel based on which packet signal of the different packet signals is received at the dedicated pin.

11. The display device of claim 7, further comprising:

an interface connected to the circuit, wherein the interface is configured to activate or deactivate according to which packet signal is received at the dedicated pin.

12. The display device of claim 11, further comprising a host device configured to control a backlight of the display panel when the interface is deactivated.

13. The display device of claim 11, wherein the display panel is configured to output a black display frame when the interface of the circuit is deactivated.

14. The display device of claim 13, wherein the display panel includes a gamma controller or a display driver that is deactivated when the display panel is outputting the black display frame and the interface of the circuit is deactivated.

15. A computing device comprising:

a housing comprising an opening; and a display device disposed within the opening, the display device comprising:

a display panel, a circuit connected to the display panel and comprising a dedicated pin, an interface connected to the circuit, and a host device connected to the interface and the dedicated pin, the host device configured to:

provide different packet signals to the dedicated pin to cause the interface to activate or deactivate, and transition the display panel between operating modes based on an activation state of the interface.

16. The computing device of claim 15, wherein the operating modes of the display panel include a low power display on mode characterized in that the interface of the circuit is deactivated and the display panel operates according to a minimal amount of charge for the display panel to provide a black output.

17. The computing device of claim 15, wherein the different packet signals include a high signal, a low signal, and a pulse signal.

18. The computing device of claim 15, wherein the display panel includes a gamma controller and a display driver that are each configured to deactivate at least when the interface of the circuit is deactivated.

19. The computing device of claim 15, wherein the display panel includes a pixel array that is configured to receive a signal from the host device at least when the interface of the circuit is deactivated.

20. The computing device of claim 15, wherein the host device is further configured to deactivate a backlight of the display panel when the interface of the circuit is deactivated.

* * * * *